US006027413A

United States Patent [19]

Smith et al.

[11] Patent Number: 6,027,413

[45] Date of Patent: Feb. 22, 2000

[54] GOLF CLUB SWING TRAINING METHOD

[76] Inventors: S. Gregory Smith, Nine Gates Rd., Yorklyn, Del. 19736; David B. Seeman, 29 Basil Ct., Hockessin, Del. 19707

[21] Appl. No.: 09/176,646

[22] Filed: Oct. 22, 1998

[51] Int. Cl.[7] ..... A63B 69/36

[52] U.S. Cl. ..... 473/215; 473/276; 473/212

[58] Field of Search ..... 473/212, 276, 473/409

[56] References Cited

U.S. PATENT DOCUMENTS

| | | | |
|---|---|---|---|
| 3,069,169 | 12/1962 | Topping | 473/212 |
| 3,679,214 | 7/1972 | Boyte | 273/189 R |
| 4,359,221 | 11/1982 | Taylor | 473/212 X |
| 4,895,373 | 1/1990 | Richmon | 273/183 B |
| 5,024,443 | 6/1991 | Bellagamba | 473/212 |
| 5,188,365 | 2/1993 | Picard | 273/189 R |
| 5,295,690 | 3/1994 | Johnson | 273/187.2 |
| 5,397,122 | 3/1995 | Herridge | 273/189 R |
| 5,665,015 | 9/1997 | Clark | 473/409 |
| 5,718,640 | 2/1998 | Noblin | 473/212 |

*Primary Examiner*—George J. Marlo
*Attorney, Agent, or Firm*—Herbert M. Wolfson

[57] ABSTRACT

A golf club swing training method wherein the golfer swings a club while having a length of elastic material connected at one end to the elbow and connected at the other end at the contralateral hip of the golfer.

2 Claims, 4 Drawing Sheets

GOLF CLUB SWING TRAINING METHOD

FIELD OF THE INVENTION

This invention relates to a novel golf swing training device. More particularly, it relates to a device for coordinating the movement of the golfer's arms with his or her upper body.

BACKGROUND OF THE INVENTION

The golf swing is very difficult for golfers to learn to do efficiently because of the large number of variables involved in hitting the ball correctly. The number of joints involved include those in the ankles, knees, hips, shoulders, elbows, wrists, and the spine. Possible movements of these joints include rotation, flexion, extension, pronation, supination, adduction, and abduction. The permutations and combinations of these movements are obviously quite large; and the chance of the amateur golfer to perform them all correctly is obviously quite small. The most common undesirable manifestations of the amateur's problems are slicing (or the ball moving from left to right for a right handed golfer) and hooking (the ball moving from right to left for a right handed golfer).

In order to help the golfer avoid these problems, a variety of swing aids have been proposed. These include golf clubs with offsets or special designs in an effort to correct the unwanted shot; attachments to the club that attempt to help the golfer align the wrists and hinge properly at the top of the swing; clubs with hinged shafts to teach tempo; devices which stand behind the golfer to guide the shaft of the club on a proper plane back and through the ball. None have been completely successful.

It was an object of the inventors of this invention to study the fundamentals of the golf swing and, from this study, to arrive at a training device that would succeed in lowering the amateurs' score significantly.

The fundamentals of the modern golf swing basically include the following steps:

1. A stable lower body on the back swing;
2. A shoulder turn (upper body) when taking the club back on the back swing;
3. Keeping the arms and hands between the shoulders throughout the swing;
4. Maintaining an active body on the forward swing; and
5. Swinging the arms to the left of the target line and body at the completion of the swing.

In short, it was an object of this invention to provide a training device that would coordinate the movement of the arms (and therefore the hands) with the upper body.

When the upper body is not coordinated with the arms, a variety of swing errors and therefore trajectory errors can result. The following are examples of such errors (all for a right handed golfer):

1. If the right arm comes above the left in the backswing, a slice will result.
2. If the golfer brings the arms up and over the ball (called "coming over the top"), a slice will result.
3. If the golfer raises the right elbow away from the body, loss of power and accuracy will result.
4. If the golfer does not bend the right elbow during the swing, severe loss of power and, therefore, reduced distance will result.
5. If the golfer swings the arms to the right on the follow-through, a hook will result.

6. If the arms are not moved with the upper body, inaccuracies in trajectory will occur.
7. If the golfer performs a combination of the above errors, his problems are multiplied several-fold.

It is the basic object of this invention to provide a device that will train the muscles of the golfer in a proper swing and allow him or her to feel the swing correctly and see the result of the proper swing.

The prior art is replete with devices to train the golfer in a proper swing. However, none have been successful.

U.S. Pat. No. 5,718,640 to Noblin discloses a golf swing training device wherein the arm is tethered with an nonelastic band which slides along the belt. This tends to restrict the backswing we are seeking and also tends to prevent the proper follow-through of the forward swing.

Boyte, in U.S. Pat. No. 3,679,214, similarly uses a belt to keep the arms in position but the band attached to the belt does not slide. This device has the same restrictions as Noblin on the forward swing and the backswing.

Picard in U.S. Pat. No. 5,188,365 attaches the elbow to the proximal hip. This serves to keep the elbow in but does not teach stretching between the left hip and hands in a manner that we believe a training device should function. By affixing to the contralateral hip and elbow, i.e., attached to the left hip and fixed at the right elbow, as discussed hereinafter, the student feels the tension increase as the distance increases between the two during the backswing. Since both hands are on the club head, the reaction of the right elbow tends to increase the distance between left hip and left shoulder, as well as between the left hip and the hands gripping the club.

In U.S. Pat. No. 4,895,373, Richmon holds the left shoulder with an elastic band extending around the golfer's waist. Attachment is at the head of the femur. This is complex to secure and does not allow a firm fixation on the left hip, which is the anchor point for the swing. It further encourages an upward movement in the backswing, detrimental to a level swing.

Johnson's training device, in U.S. Pat. No. 5,295,690, holds both biceps together. This limits the distance between the left hip and the left shoulder. This distance would be greater if attached to the right elbow alone rather than bind both biceps together. Since Johnson attaches to the bicep, this distance is not maximized as it would be if attached to the elbow. Furthermore, fixation is more difficult and there would be a strong tendency for the Johnson device to slide up toward the shoulder. A device, anchored at the elbow would provide a more natural fixation point. Since the elbow would be distal to the bicep, such a device would provide more stretching of the left hip to left shoulder. Johnson's design encourages a turn. The object of our invention is to provide a swing that is substantially straight back. Furthermore, since the hip attachment is elastic in the Johnson device, the feel of increasing the distance between the left hip and left shoulder, an object of our invention, is not achieved.

Herridge, in U.S. Pat. No. 5,397,122 attached the bicep to the proximal hip and specifies that stretch not be applied in the backswing. This would make it much more difficult for the golfer to feel and would not teach stretching of the back. It is an objective of our invented device to encourage the proper motion, to compel the golfer to stretch the back. Furthermore, with our device, once the golfer achieves the proper backswing position, the length of elastic material can be replaced by a stiffer material to build the golfer's muscular strength for increased power and distance in the future.

Clark in U.S. Pat. No. 5,665,015, provides an apparatus wherein the chest, wrist and shoulder are all connected and the golfer is advised to raise the club above the head. This is precisely the type of swing, with an up and down motion, that should be avoided. It encourages an upward movement in the backswing with a high angle of contact and thus increases the risk of the golfer losing his balance and control.

SUMMARY OF THE INVENTION

The invention comprises a system for coordinating the movement of the arms with the upper body. It comprises, in general, (1) anchoring means, usually integral or attached to a belt around the waist, (2) a length of elastic material, e.g., an elastic band, and (3) a belt or sleeve fitted or sized for the elbow. The elastic band is connected at one end to the anchoring means on the waist belt at the hip and then connected at its other end to the elbow on the opposite side of the golfer's body, i.e., the elbow contralateral to the hip containing the anchoring means.

Specifically, the golf swing training device of this invention comprises:

a. A length of elastic material, e.g., an elastic band, having a length and a width and two ends;

b. anchoring means positioned at and secured to the hip of the right handed or left handed golfer and adapted to anchor one end of said elastic band;

c. a sleeve fitted and sized for an elbow of the golfer's arm contralateral to the hip where the anchoring means is positioned and adapted for connection to the other end of the elastic band.

If the band is connected to the left lateral hip and the right elbow of the right handed golfer, the following situations would be remedied:

1. A golfer would not be able to keep both arms straight in the backswing. As the club is taken back tension is produced on the elbow causing it to bend to the proper position.

2. A golfer would not be able to come over the top. The tethering effect would keep the right arm from coming over the left arm.

3. A golfer would not be able to raise the right elbow up and away from the body. The tension on the elbow would keep it in proper position.

The effect of using this training device would be to correct all the foregoing faults while still allowing a natural swing.

An alternative embodiment of this invention is to attach one end of the elastic material to the leading hip of the golfer and affix the other end to a stationary element, e.g., a post or similar element, placed in the ground behind the golfer, instead of attaching it to the sleeve fitted over the golfer's elbow.

A further, but temporary embodiment of the training device of this invention, involves a second length of elastic material attached at one end to an anchoring means at the leading hip of the golfer and, at its other end, attached to a post or other stationary element behind the golfer.

DETAILED DESCRIPTION OF THE INVENTION

Figure 1:
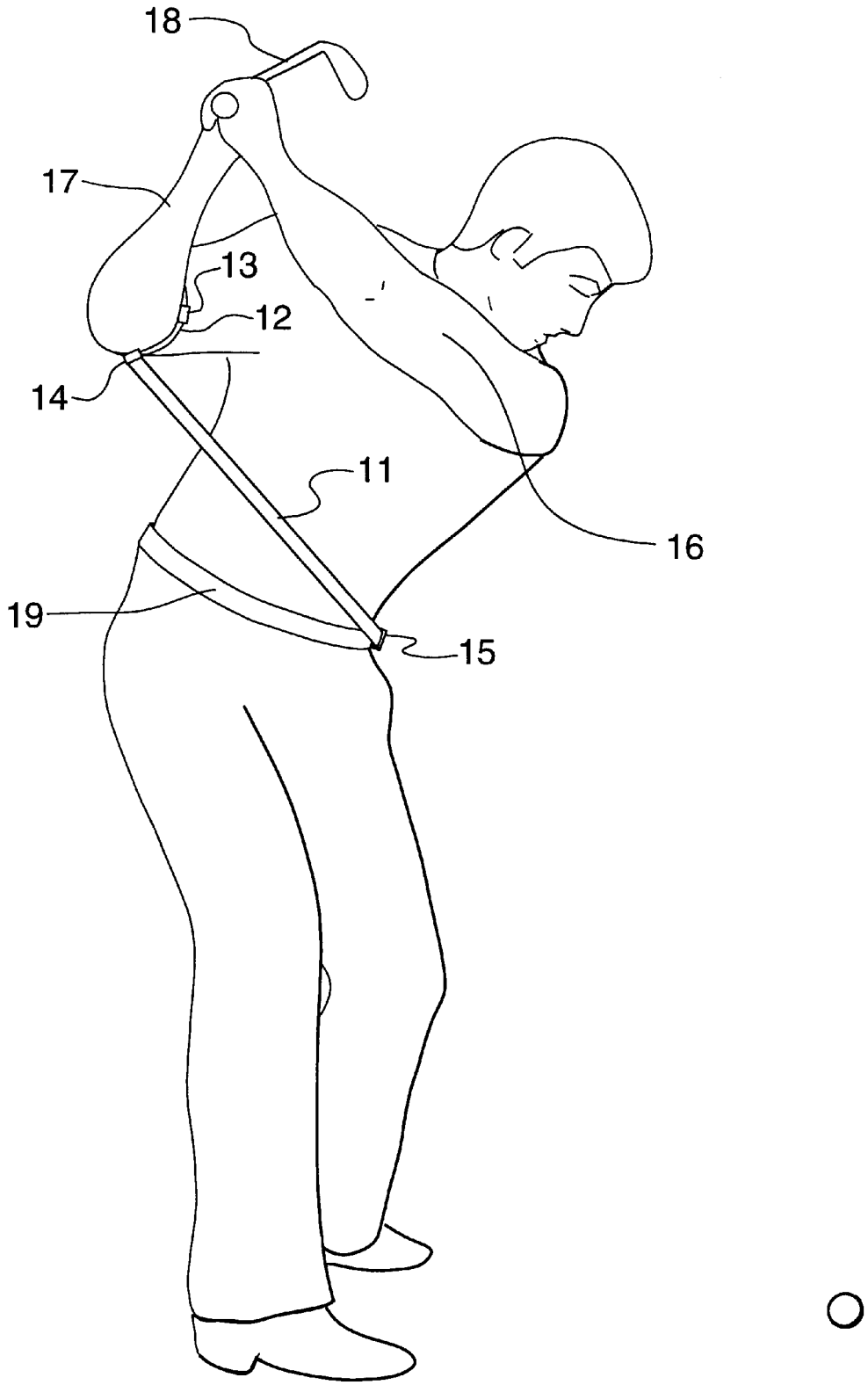
FIG. 1 is a side view, in perspective, of a golfer at the completion of his backswing, showing the position of the golf swing training device.
Figure 2:
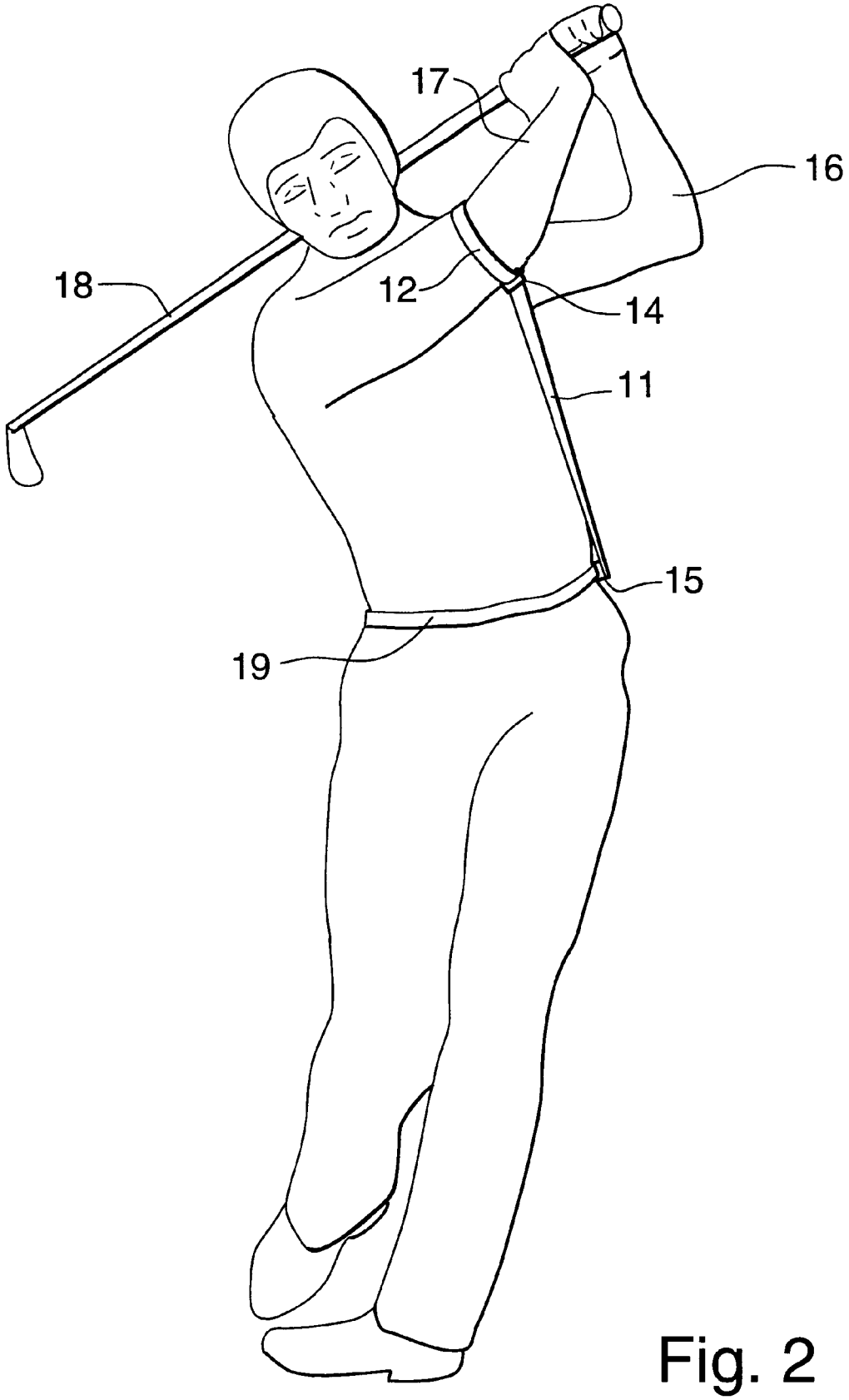
FIG. 2 is a front view, in perspective, of a golfer at the completion of his forward swing showing the position of the golf swing training device.
Figure 3:
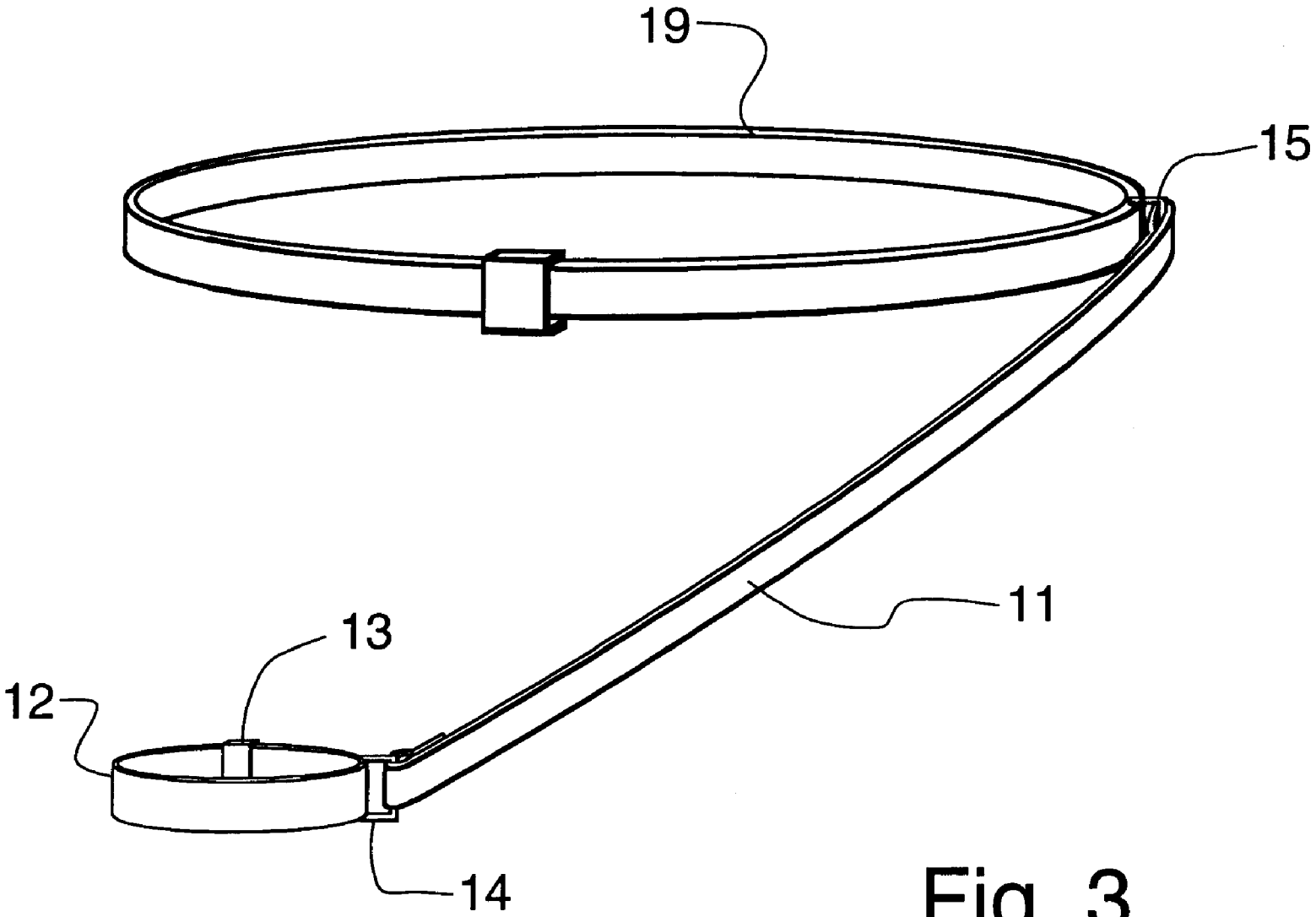
FIG. 3 is a view, in perspective of an embodiment of the golf swing training device.
Figure 4:
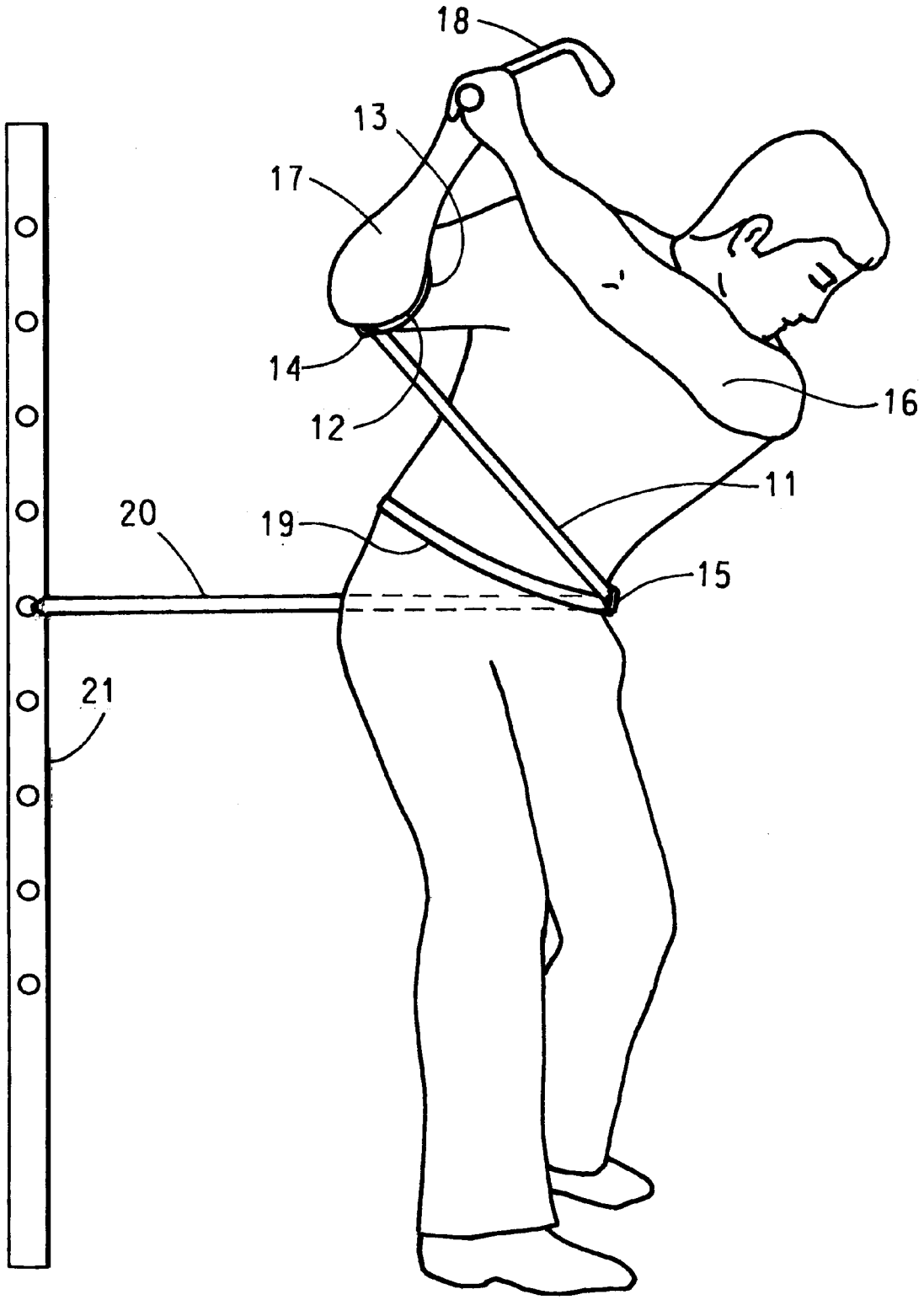
FIG. 4 is a view, in perspective of another embodiment of the golf swing training device.

The golf swing training device shown in FIGS. 1, 2 and 3 comprise a length of flexible, resilient material, e.g., elastic band, tubing or the like 11; a sleeve or loop member 12, adapted to encircle the golfer's elbow, and, optionally, an adjusting member 13, adapted to adjust the size of the loop or sleeve that encircles the golfer's elbow; an upper anchoring means 14 to secure one end of the elastic band 11 to sleeve 12; a lower anchoring means 15 adapted to secure the other end of the elastic band 11 to the optional waist band or belt 19 at the hip contralateral to the attachment 14 at the golfer's elbow.

Wearing the golf swing training device, the golfer stands in the address position with his arms hanging down naturally. The device should feel snug from the waist area to the elbow area. Adjustment should be made by means, not shown, to either adjust the length of the elastic band or its elasticity as well as the sleeve or loop to provide a snug feeling.

FIG. 1 shows the proper positioning of the right-handed golfer's target arm 16, its elbow above the connection 15 of the elastic band 11 at the golfer's left hip and the sleeve or loop 12 around the elbow of the golfer's trail arm 17 at the top of the backswing of the golf club 18.

FIG. 2 shows the proper position at the completion of the swing of the golf club 18. The elbow of the target arm 16 has moved slightly to the left of a position directly above the lower attachment 15 at the waist of the golfer and the elbow of the trail arm 17, to which the elastic band is connected is now at a position directly above the lower attachment 15. The length of elastic material 11 between the elbow at 12 and the hip at 15 is still under tension to ensure that the trail side of the body has turned properly through the swing and balance has been maintained.

The golf swing training device of this invention allows the golfer to feel the proper arm position so that the arms are maintained in proper relationship to the torso throughout the golf swing. To know that his swing is approaching perfection, the golfer should feel a pulling or stretching during the swing. Over time, the use of the device of this invention will enable the golfer to make proper swings with regularity, even when he is not wearing the training device.

In the event that the golfer's poor habits are slow in being corrected by the training device of this invention, it has been found that the elbow connection can be transferred to a stationary element behind the golfer. With only the golfer's hip involved, instead of hip and elbow, and by consciously stretching the device during the swing, some golfers will find it easier to break their bad habits in their swing.

Another embodiment of this invention involves the use of a second length of elastic material 20 attached to the golfer's hip and to the stationery element 21 behind the golfer. This would provide a second means, along with the connection between the hip and the elbow to control and to teach the proper golf swing for distance and accuracy.

EXPERIMENTS

A prototype has been used with two golf professionals and a very high handicap amateur:

1. The amateur traditionally takes the club back with straight arms resulting in a very feeble hit. The use of the invented training device allowed the amateur to bend the right elbow properly resulting in a proper wrist hinge and much more power.

2. One professional had been struggling with his arms being slightly out of synchronization with the upper body. The training device was first attached to the left hip and the right elbow for five minutes and then to the right hip and left elbow for five minutes while the pro hit practice balls. After removing the device the "feel" for the coordination between the arms and the upper body was greatly improved with much better ball contact.

3. The second professional was extending his arms too far on the backswing which caused him to lose his balance and tip his spine to the left; on the forward swing his weight would shift back in the other direction resulting in a low, poor trajectory shot. After using the device in a similar fashion as above, his balance improved markedly and he hit the ball much better with an excellent trajectory.

Although there is sometimes inferred that there is only "one correct golf swing," there has been an evolution of the golf swing with different variations. For example, many teachers encourage a turning of the shoulders coupled with a large turning of the hips and legs to generate power in a swing. The swing typically has the left knee bending and the left heel pulling off the ground during the backswing.

The device of this invention is focused on a more specific swing. In this swing, the lower body does not move much in the backswing. There is internal rotation of the left thigh and a small movement of the hip on the backswing but the left foot stays on the ground. Power is generated by increasing the distance between the left hip and the left shoulder and similarly between the left hip and the hands. Both hands should be as far away from the chest as possible. (This puts the weight on the right side with no tendency to drift upward). The lower body is very active in the forward swing—we do not call it a downswing as a very flat angle to the ball results in very acceptable results even if it is not perfect. A downswing, however, implies a steep angle of the club into the ball. Errors here result in "fat" shots, "thin" shots, and topping the ball. Finally, the arms finish well left of the center of the body allowing maximum weight transfer and maximum speed of head of the club, since the head is traveling through a greater distance.

This swing has a simple appearance when executed properly. The club goes back, the lower body essentially moves little, the upper body stretches to create energy, the lower body coils or fires at the ball, increasing the coil of the upper body since the legs have fired forward and the upper body is still stretched back. This minimal movement on the back swing decreases the standard error of the body and, therefore, prevents the arms and club from being up, down, right, or left. Accuracy is also improved since both feet remain on the ground, as opposed to the forward leg, during the improper swing, being almost pulled off the ground. This improves accuracy.

The key component of this simple but very strong swing is to first teach the student to stretch the distance between the lift iliac crest (hip) and the left shoulder as well as the left hip and the hands. The second important component is to finish well on the left side; so much so that the back of the golfer is now facing the original location of the ball.

The device may be used by right- and left-handed male and female golfers regardless of their size or ability.

What is claimed is:

1. A method of controlling a golfer's swing comprising fitting a sleeve about the elbow of the golfer's trailing arm, connecting a length of elastic material of substantial extent to said sleeve and extending said elastic material downwardly across the front of the golfer's upper body, anchoring the end of the extended length of material to an anchoring means in the region of the golfer's waist at the hip contralateral to the elbow fitted with said sleeve and below the golfer's leading arm, whereby when the golfer swings, the trailing arm will follow the turning of the golfer's upper body against the substantially stationary lower body while both hands of the golfer are extended as far from the golfer's chest as possible during the backswing.

2. A method as in claim 1 wherein one end of a second length of elastic material is attached to the hip and the other end of said second length is attached to a post or other stationary object behind the golfer.

* * * * *